US010329708B2

(12) United States Patent
Shin et al.

(10) Patent No.: US 10,329,708 B2
(45) Date of Patent: Jun. 25, 2019

(54) DRYER FOR CLOTHES

(71) Applicant: LG ELECTRONICS INC., Seoul (KR)

(72) Inventors: Jinhyouk Shin, Seoul (KR); Woocheol Kang, Seoul (KR); Minseong Kim, Seoul (KR); Sungjun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 336 days.

(21) Appl. No.: 15/304,391

(22) PCT Filed: Apr. 20, 2015

(86) PCT No.: PCT/KR2015/003927
§ 371 (c)(1),
(2) Date: Oct. 14, 2016

(87) PCT Pub. No.: WO2015/163654
PCT Pub. Date: Oct. 29, 2015

(65) Prior Publication Data

US 2017/0037561 A1 Feb. 9, 2017

(30) Foreign Application Priority Data

Apr. 21, 2014 (KR) ..... 10-2014-0047179

(51) Int. Cl.
*F26B 3/00* (2006.01)
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
CPC ..... D06F 58/02
(Continued)

(56) References Cited

U.S. PATENT DOCUMENTS

2007/0144028 A1* 6/2007 Audet ..... D06F 58/22 34/82
2009/0165330 A1* 7/2009 Krausch ..... D06F 58/22 34/480
(Continued)

FOREIGN PATENT DOCUMENTS

CN 1637201 7/2005
CN 101775735 7/2010
(Continued)

OTHER PUBLICATIONS

International Search Report and Written Opnion dated Jun. 10, 2015 issued in Application No. PCT/KR2015/003927 (full English text).
(Continued)

*Primary Examiner* — John P McCormack
(74) *Attorney, Agent, or Firm* — Ked & Associates, LLP

(57) ABSTRACT

Provided is a dryer for clothes. The dryer for the clothes includes a cabinet, a drying drum accommodated in the cabinet, a suction passage supplying hot air into the drying drum, a heating unit disposed on one position of the suction passage to heat the air introduced into the suction passage at a high temperature, an exhaust passage through the hot air discharged from the drying drum flows, a blower mounted on one position of the exhaust passage to forcibly blow the air within the drying drum, a lint filter mounted on the other position of the exhaust passage, a guide duct defining a portion of the exhaust passage to accommodate the lint filter therein, and a blocking member disposed at a position where the air discharged from the drying drum flows.

9 Claims, 5 Drawing Sheets

(58) Field of Classification Search
USPC ..... 34/80, 82, 667
See application file for complete search history.

(56) References Cited

U.S. PATENT DOCUMENTS

| | | | |
|---|---|---|---|
| 2011/0225837 | A1 | 9/2011 | Ahn et al. |
| 2012/0084992 | A1 | 4/2012 | Shin et al. |
| 2012/0144687 | A1 | 6/2012 | Yeom |

FOREIGN PATENT DOCUMENTS

| | | |
|---|---|---|
| CN | 103590216 | 2/2014 |
| EP | 1 389 644 | 2/2004 |
| JP | S49-015988 | 4/1974 |
| JP | S52-057461 U | 4/1977 |
| JP | S57-142299 | 9/1982 |
| JP | S60-194250 | 10/1985 |
| JP | H10-096550 | 4/1998 |
| JP | 2003-274523 | 9/2003 |
| JP | 2008-178602 | 8/2008 |
| JP | 2011-172344 | 9/2011 |
| JP | 2013-081636 | 5/2013 |
| KR | 10-2004-0015523 | 2/2004 |
| KR | 20-0429066 | 10/2006 |
| KR | 10-0664507 | 1/2007 |
| KR | 10-0685965 | 2/2007 |
| KR | 10-2011-0125570 | 11/2011 |
| KR | 10-2012-0066549 | 6/2012 |

OTHER PUBLICATIONS

Chinese Office Action dated Apr. 28, 2017 issued in Application No. 201580018913.9 (with English translation).
Russian Search Report dated Oct. 12, 2017 issued in Application No. 2016141067.
Japanese Office Action dated Nov. 14, 2017 issued in Application No. 2017-503757.
European Search Report dated Nov. 21, 2017 issued in Application No. 15782319.6.
Japanese Decision to Grant a Patent dated May 29, 2018 issued in Application No. 2017-503757.

* cited by examiner

[Fig. 1]
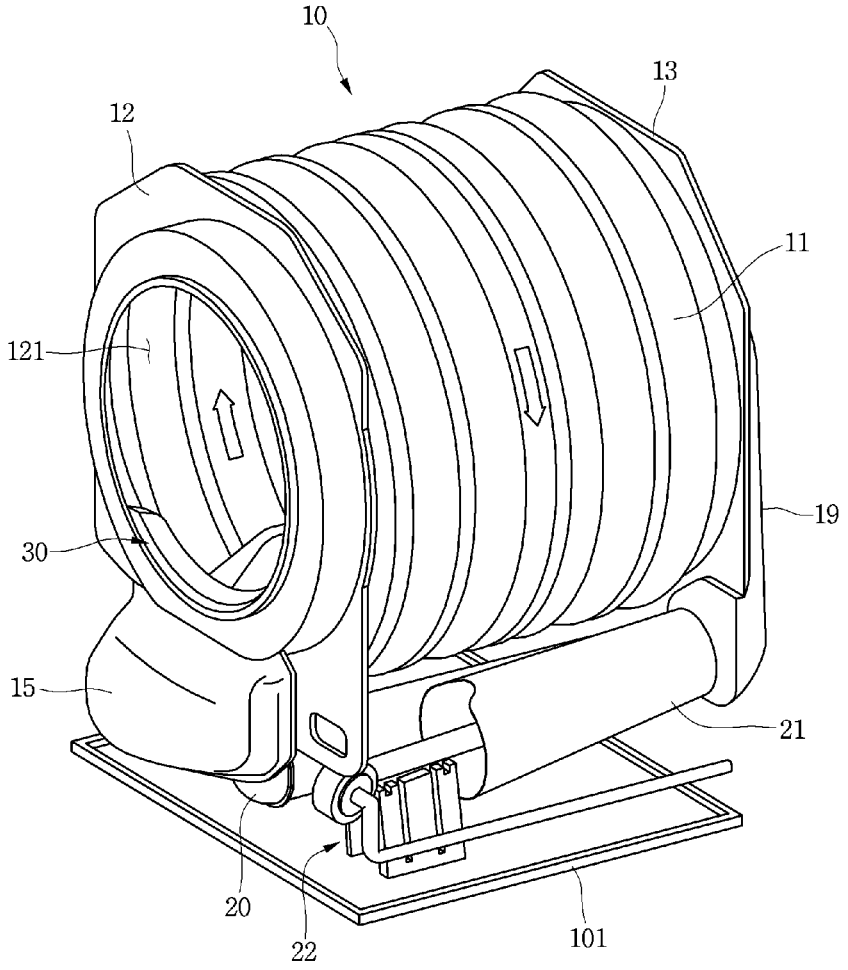

[Fig. 2]
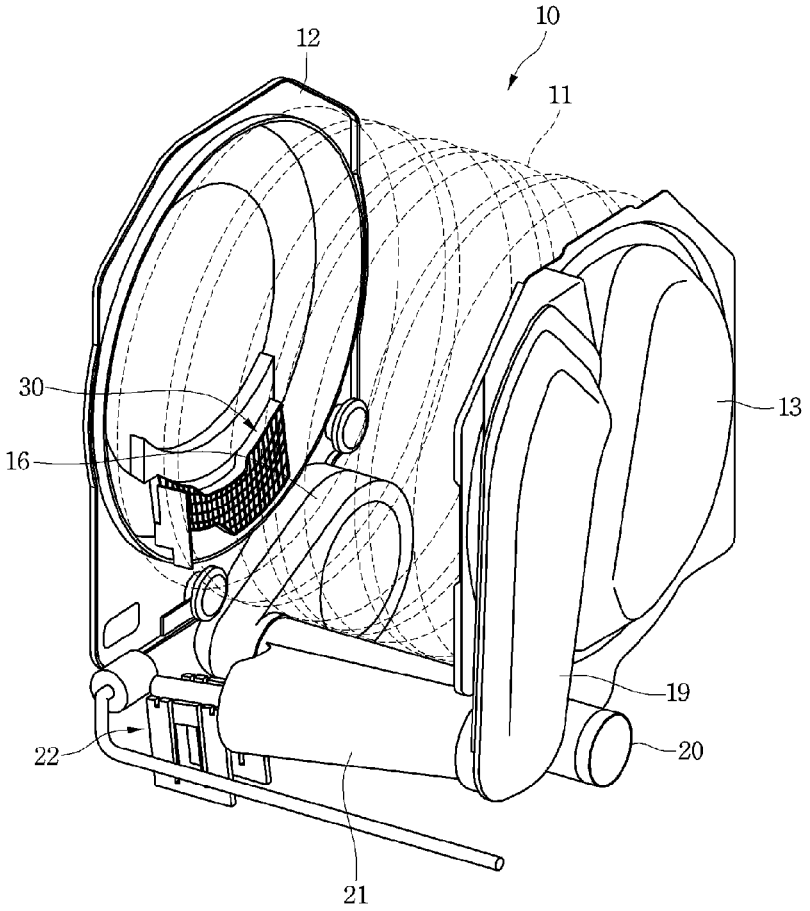
[Fig. 3]
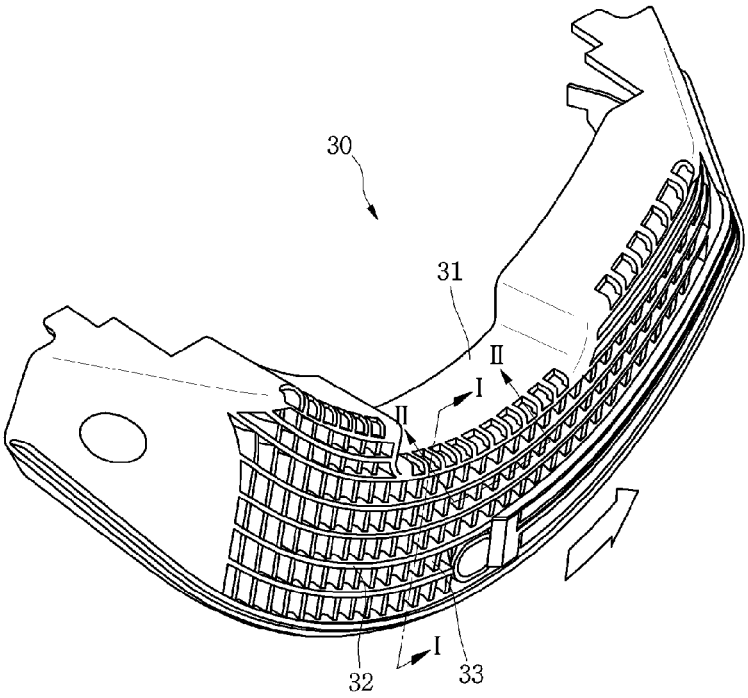

[Fig. 4]
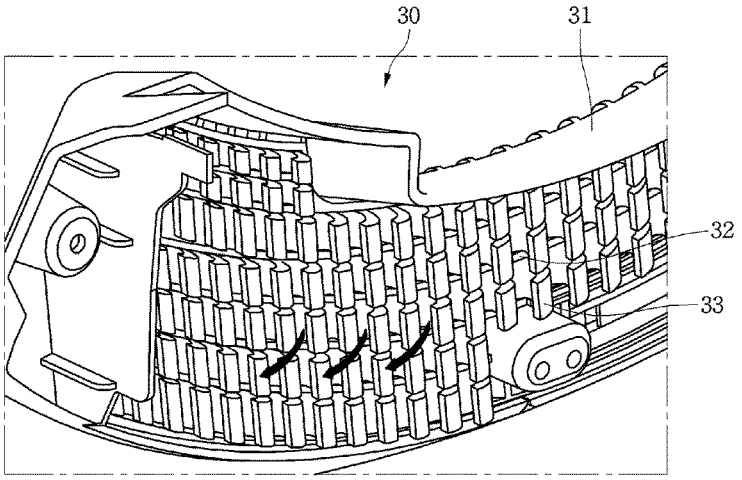
[Fig. 5]
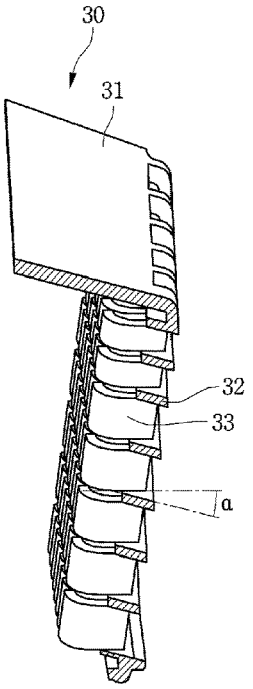
[Fig. 6]
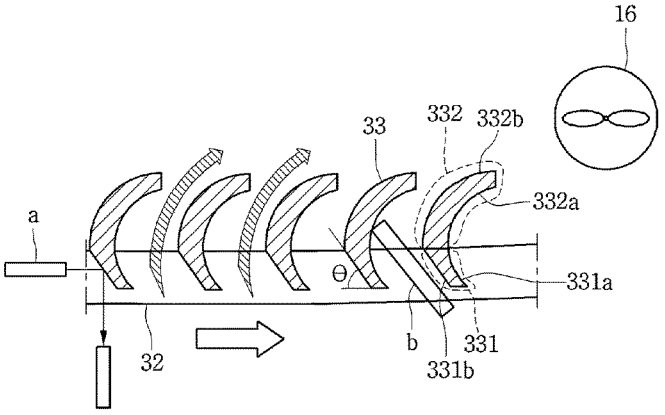

[Fig. 7]
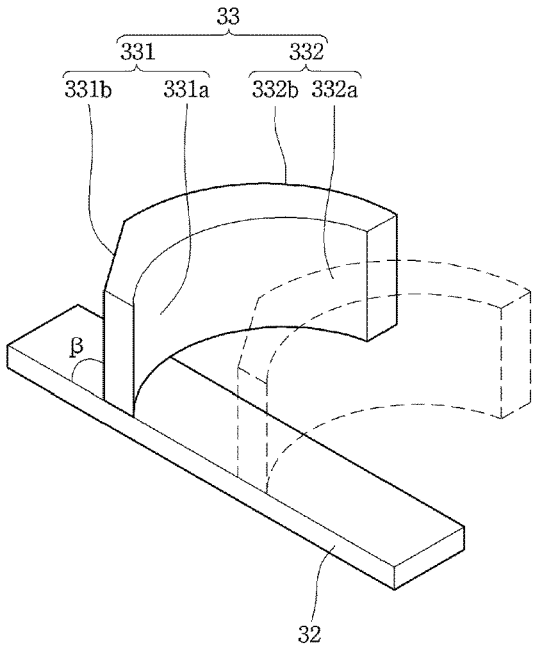
[Fig. 8]
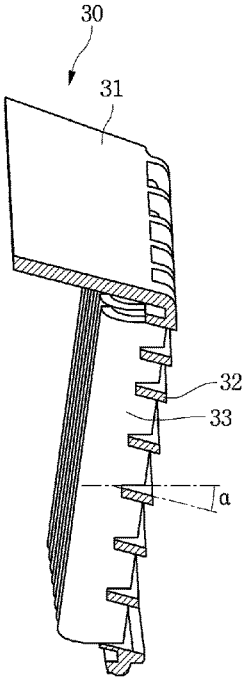

[Fig. 9]
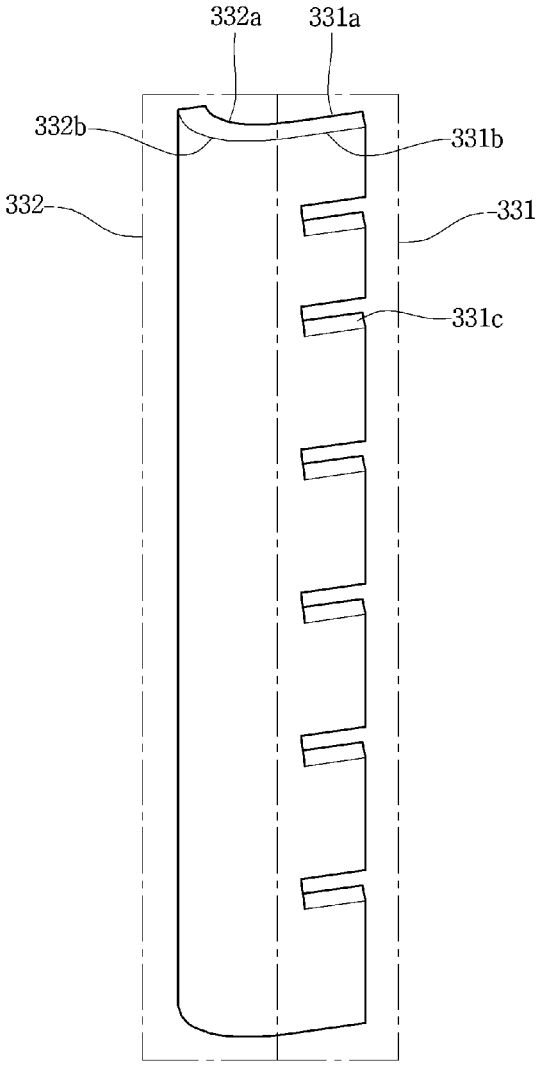

DRYER FOR CLOTHES

CROSS-REFERENCE TO RELATED PATENT APPLICATIONS

This application is a U.S. National Stage Application under 35 U.S.C. § 371 of PCT Application No. PCT/KR2015/003927, filed Apr. 20, 2015, which claims priority to Korean Patent Application No. 10- 2014-0047179, filed Apr. 21, 2014, whose entire disclosures are hereby incorporated by reference.

TECHNICAL FIELD

The present disclosure relates to a dryer for clothes.

BACKGROUND ART

Dryer for clothes are home appliances that supply hot wind into a drying drum to remove moisture absorbed into clothes in a state where objects to be dried are put into the rotating drum. Hot wind supplied into a drum may be generated by using electrical resistance heat or combustion heat using a gas fuel. Then, the hot wind may be supplied into the drying drum by using a blower fan.

Also, dryers for clothes may be classified into forced convection dryers and air vented dryers according to a hot air supply method. That is, the forced convection dryers may be dryers in which hot air supplied into a drying drum is repeatedly heated and cooled while circulating the inside of the dryer, and the air vented dryers may be dryers in which hot air supplied into a drying drum is discharged from the drying drum to the outside.

During the drying of clothes, various flexible and rigid foreign substances contained in the clothes may be separated out of the clothes to drop down onto the bottom of the drying drum, as well as lint attached to clothes may be separated and thus floated in air discharged from a drying drum.

Thus, when the flexible and rigid foreign substances are introduced into a discharge passage for the air discharged from the drying drum, the foreign substances may damage a drying fan or increase in load of the fan to deteriorate drying performance. Also, the lint generated during the drying process may be introduced into a combustion device or electric component through a gap between the drying drum and a cabinet to cause fire in the dryer.

Particularly, during the drying, vibration and noises may be generated by the rigid foreign substances that drop down onto the bottom of the drying drum. Here, the flexible foreign substances may include hairs, rubber bands, threads, snack packs, fabrics, and the like. The rigid foreign substance may include cotton swabs, toothpicks, hairpins, underwear wires, safety pins, small accessories, buttons, and the like. In the dryer according to the related art, when foreign substances are put into the dryer, a foreign substance dropping groove has to be separately defined in a front end of a blower.

Also, when the foreign substance dropping groove is defined, a structure for taking and throw out the foreign substances accumulated in the foreign substance dropping groove is needed.

In addition, although the heavy foreign substances drop down and then are collected into the foreign substance dropping groove, light foreign substances such as cotton swabs may not drop into the foreign substance dropping groove, but be introduced into the blower to damage the blower or deteriorate blowing performance.

Also, when the foreign substances are deposited in the foreign substance dropping groove, the lint may be caught by the deposited foreign substances and thus deposited together with the foreign substances to significantly increase air flow resistance.

DISCLOSURE OF INVENTION

Technical Problem

The present disclosure has been proposed to improve the above-described limitations.

Solution to Problem

In one embodiment, a dryer for clothes includes: a cabinet; a drying drum accommodated in the cabinet and into which an object to be dried is put; a suction passage supplying hot air into the drying drum;a heating unit disposed on one position of the suction passage to heat the air introduced into the suction passage at a high temperature; an exhaust passage through the hot air discharged from the drying drum flows; a blower mounted on one position of the exhaust passage to forcibly blow the air within the drying drum; a lint filter mounted on the other position of the exhaust passage; a guide duct defining a portion of the exhaust passage to accommodate the lint filter therein; and a blocking member disposed at a position where the air discharged from the drying drum flows, the blocking member configured to filter foreign substances contained in the air discharged from the drying drum before the air discharged from the drying drum is guided to the guide duct, wherein the blocking member comprises: a plurality of blocking ribs horizontally spaced a predetermined distance from each other; and a plurality of partition ribs horizontally extending and vertically spaced a predetermined distance from each other, the plurality of partition ribs configured to connect the plurality of blocking ribs to each other, and wherein one surface of each of the plurality of blocking ribs defines an inclination surface that is inclined at an acute angle, which is less than an angle of 90 degrees, with respect to a vertical surface that extends in a horizontal direction of the drying drum.

In another embodiment, a dryer for clothes, includes: a cabinet; a drying drum accommodated in the cabinet and into which an object to be dried is put; a suction passage supplying hot air into the drying drum; a heating unit disposed on one position of the suction passage to heat the air introduced into the suction passage at a high temperature; an exhaust passage through the hot air discharged from the drying drum flows; a blower mounted on one position of the exhaust passage to forcibly blow the air within the drying drum; a lint filter mounted on the other position of the exhaust passage; a guide duct defining a portion of the exhaust passage to accommodate the lint filter therein; and a blocking member disposed at a position where the air discharged from the drying drum flows, the blocking member configured to filter foreign substances contained in the air discharged from the drying drum before the air discharged from the drying drum is guided to the guide duct, wherein the blocking member comprises: a plurality of blocking ribs horizontally spaced a predetermined distance from each other; and a plurality of partition ribs horizontally extending and vertically spaced a predetermined distance from each other, the plurality of partition ribs connecting the plurality of blocking ribs to each other, and each of the plurality of blocking ribs extends to be rounded towards the blower.

Advantageous Effects of Invention

The dryer for the clothes according to the embodiment may have following effects.

First, it may be unnecessary to form the separate foreign substance dropping groove for collecting the foreign substances in the air passage within the dryer.

Second, since the separate groove structure for collecting the foreign substances is unnecessary, it may be unnecessary to perform the separate maintenance for removing the deposited foreign substances in the foreign substance dropping groove.

Third, the introduction of the flexible or rigid foreign substances except for the lint into the passage may be fundamentally prevented to prevent the components of the dryer from being damaged due to the accumulation of the foreign substances.

Fourth, since the flexible or rigid foreign substances are not put into the air passage, the occurrence of the vibration and noise may be reduced during the drying.

BRIEF DESCRIPTION OF DRAWINGS

FIG. 1 is a front perspective view of a dryer for clothes, which includes a blocking member according to an embodiment.

FIG. 2 is a rear perspective view of the dryer for the clothes.

FIG. 3 is a front perspective view of the blocking member according to an embodiment.

FIG. 4 is a partial perspective view illustrating a rear surface of the blocking member.

FIG. 5 is a cross-sectional view taken along line I-I of FIG. 3.

FIG. 6 is a transverse cross-sectional view taken along line II-II of FIG. 3.

FIG. 7 is a partial perspective view illustrating a structure of a blocking rib of a blocking member according to another embodiment.

FIG. 8 is a cutaway perspective view illustrating a structure of a blocking member according to another embodiment.

FIG. 9 is a perspective view of a blocking rib constituting the blocking member according to another embodiment.

MODE FOR THE INVENTION

Hereinafter, a dryer for clothes including a lint filter cleaning device according to an embodiment will be described in detail with reference to the accompanying drawings. Also, an air vented dryer will be described as an example of the dryer for the clothes including the lint filter cleaning device according to an embodiment. However, the lint filter cleaning device according to an embodiment may be applied to various types of dryers for clothes including a forced convection dryer as well as the air vented dryer.

FIG. 1 is a front perspective view of a dryer for clothes, which includes a blocking member according to an embodiment, and FIG. 2 is a rear perspective view of the dryer for the clothes.

Referring to FIGS. 1 and 2, a dryer for clothes (hereinafter, referred to as a "clothes dryer") including a blocking member may include a drying drum 11 into which objects to be dried are put, a front cabinet 12 supporting a front portion of the drying drum 11, the blocking member 30 mounted on a bottom part of the front cabinet 12, and a rear cabinet 13 supporting a rear portion of the drying drum 11.

In detail, the clothes dryer 10 may further include a suction duct 21 for suctioning air to be supplied into the drying drum 11, a rear duct 19 connecting the suction duct 21 to an air inflow hole defined in a rear surface of the drying drum 11, a guide duct 15 connected to a bottom surface of the front cabinet 12 to guide air discharged from the drying drum 11, a blower 16 connected to an outlet end of the guide duct 15, and an exhaust duct 20 connected to an outlet end of the blower 16. Also, a lint filter (not shown) for collecting lint may be mounted inside the guide duct 15.

A middle cabinet (not shown) is disposed between the front cabinet 12 and the rear cabinet 13 to protect the drying drum 11 and various components disposed under the drying drum 11. The middle cabinet may define both side surfaces and top surface of the clothes dryer 10. A base plate 101 defining a bottom portion of the clothes dryer 10 may be disposed on a bottom surface of the middle cabinet, and the components may be mounted on the base plate 101.

Also, the blocking member 30 may prevent foreign substances contained in the objects to be dried, for example, bulky and rigid foreign substances a coin, a ballpoint pen, and the like or soft foreign substances such as a rubber band and the like from being suctioned into the guide duct 15 during the drying process. The foreign substances such as the lint may be filtered by the lint filter 15 even though the foreign substances are introduced into the guide duct 15. Other foreign substances, i.e., bulky and rigid foreign substances may be blocked by the blocking member 30 to remain in the drying drum 11. If the foreign substances except for the lint are suctioned into the guide duct 15, the blower 16 may be damaged, or a rattling sound may be generated inside the exhaust duct 20. Thus, it may be necessary to prevent the foreign substances from being out of the drying drum 11 through the blocking member 30. Also, the blocking member 30 may be detachably coupled to the front cabinet 12. Also, the blocking member 30 may be mounted on a boundary between the guide duct 15 and the drying drum 11. That is, air passing through the blocking member 30 may flow into the guide duct 15 and then be guided into the exhaust duct 20 by the blower 16 mounted on an outlet end of the guide duct 15.

Also, the blower 16 includes a fan motor (not shown) and a blower fan (not shown) connected to a rotation shaft of the fan motor. The blower fan may be accommodated in a fan housing. The fan housing has an inlet end connected to the outlet end of the guide duct 15 and an outlet end connected to the exhaust duct 20.

Also, in case of the air vented dryer, a gas combustion device 22 may be disposed on an inlet of the suction duct 21 to heat air suctioned into the suction duct at a high temperature. Also, in case of an electric dryer, an electric heater is mounted inside the rear duct 19 to heat air introduced into the suction duct 21 at a high temperature before the air is introduced into the drying drum 11.

Briefly explaining the drying process of the clothes dryer 10 including the above-described constitutions, objects to be dried are put into the drying drum 11 through an input hole 121 defined in the front cabinet 12. Also, when a drying start command is inputted, the blower 16 operates to heat air introduced into the suction duct 21 at a high temperature by using the gas combustion device or electric heater.

Then, the air heated at the high temperature is introduced into the drying drum 11 through a rear surface of the drying drum 11 along the rear duct 19. The high-temperature and dry air introduced into the drying drum 11 changes into high-temperature and humidity air while drying the objects to be dried. Also, the high-temperature and humidity air passes through the blocking member 30 in a state where the air contains lint generated from the objects to be dried and then is guided to the guide duct 15.

Here, the flexible or rigid foreign substances except for the lint may be filtered by the blocking member 30. Also, the lint contained in the high-temperature and humidity air is filtered by the lint filter mounted inside the guide duct 15. Also, the air passing through the guide duct 15 may be guided into the exhaust duct 20 by the blower 16 and then discharged to the outside of the dryer.

Hereinafter, a structure and function of the blocking member 30 according to an embodiment will be described in detail with reference to the accompanying drawings.

FIG. 3 is a front perspective view of the blocking member according to an embodiment, FIG. 4 is a partial perspective view illustrating a rear surface of the blocking member, and FIG. 5 is a cross-sectional view taken along line I-I of FIG. 3.

Referring to FIGS. 3 to 5, the blocking member 30 according to an embodiment may include a body 31 rounded along an edge of the input hole 121 of the front cabinet 12, a plurality of partition ribs 32 extending from the inside of the body 31 in a left/right direction and vertically spaced apart from each other, and a plurality of blocking ribs 33 disposed between the partition ribs 32 that are adjacent to each other and spaced apart from each other in a left/right direction.

In detail, the blocking member 30 may be disposed under the input hole 121 and rounded at a curvature that is equal or similar to that of the input hole 121. Also, the blocking member 30 may be bent in a "]" shape, and the partition ribs 32 and the blocking ribs 33 may be disposed on a vertical surface of the blocking member 30.

Also, the partition ribs 32 may extend from a left edge to a right edge of the blocking member 30 and be vertically spaced a predetermined distance from each other.

Also, each of the blocking ribs 33 may have top and bottom surfaces that respectively contact top and bottom surfaces of each of the partition ribs 32. Also, as illustrated in FIG. 5, each of the partition ribs 32 may be inclined downward from a horizontal surface at a predetermined angle $\alpha$. Particularly, the partition rib 32 may extend toward the inside of the drying drum 11 and inclinedly extend downward. Thus, the foreign substances colliding with the blocking member 30 may not be guided into the guide duct 15, but drop into the drying drum 11 by the partition ribs 32.

FIG. 6 is a transverse cross-sectional view taken along line II-II of FIG. 3.

Referring to FIG. 6, the blocking ribs 33 constituting the blocking member 30 according to an embodiment may be horizontally spaced a predetermined distance from each other.

In detail, the blocking ribs 33 may include a first part 331 contacting bottom and top surfaces of the partition ribs 32 which are vertically adjacent thereto and a second part 332 rounded to extend forward from the first part 331.

In more detail, as illustrated in FIG. 6, one side surface of the first part 331 may define an inclination surface 331*b* that is inclined at an acute angle $\theta$, which is less than an angle of 90 degrees, with respect to the vertical surface extending in the left/right direction of the drying drum 11. The rigid or flexible foreign substances a and b that rotate within the drying drum 11 to drop when the drying drum 11 rotates may collide with the inclination surface 331*b* and then be reflected to drop into the drying drum 11 again. As illustrated in FIG. 6, when the drum rotates in a white arrow direction, the foreign substances colliding with the blocking member 30 may initially collide with the inclination surface 331*b* and then be bounded into the drying drum 11. Also, the other side surface of the first part 331 may be rounded.

The second part 332 may be outer and inner side surfaces 332*b* and 332*a* which are rounded in the same direction and have curvatures different from each other. The outer side surface 332*b* may represent a surface connected to the inclination surface 331, and the inner side surface 332*a* may represent a surface connected to a surface opposite to the inclination surface 331*b*. Also, the opposite surface of the inclination surface 331*b*, i.e., the other side surface of the first part 331 may be smoothly rounded to be connected to the inner side surface 332*a* of the second part 332. For example, the other side surface of the first part 331 and the inner side surface 332*a* of the second part 332 may be rounded at the same curvature.

As described above, since the second part 332 is rounded at a predetermined curvature, the foreign substance b introduced between the blocking ribs 33 that are adjacent to each other may not pass through the blocking member 30, but be filtered by the blocking member 30. If the blocking rib 33 linearly extends to a front side of the drying drum 11, the foreign substance b may easily pass through the blocking member 30. However, since the blocking rib 33 is rounded, the possibility of the passing of the foreign substance may be significantly reduced.

Also, the second part 332 may be rounded in a direction of the blower 16. As illustrated in FIG. 2, the blower 16 may be disposed at a right downward side of the blocking member 30. Thus, the air passing through the drying drum 11 flows in a right downward direction along the guide duct 15. Thus, to minimize the flow resistance of the air, the second part 332 may be rounded in the direction of the blower 16. A flow of the air passing through the blocking ribs 33 that are adjacent to each other may be expressed as a black arrow.

FIG. 7 is a partial perspective view illustrating a structure of a blocking rib of a blocking member according to another embodiment.

Referring to FIG. 7, a blocking member according to the current embodiment may be the same as the blocking member 30 according to the foregoing embodiment except for a structure of the blocking rib 33.

Particularly, the blocking rib 33 according to the current embodiment may have an inclination surface 331*b* that is inclined at an acute angle $\theta$, which is less than an angle of 90 degrees, with respect to a vertical surface and also inclined at an acute angle $\beta$, which is less than an angle of 90 degrees, with respect to a horizontal surface or a top surface of a partition rib 32. According to the foregoing embodiment, the blocking rib 33 is vertically disposed with respect to the partition rib 32. On the other hand, according to the current embodiment, the blocking rib 33 may be inclined at a predetermined angle with respect to the horizontal surface. As a result, a distance between the partition ribs 32 that are adjacent to each other may be reduced, and thus, the possibility of the passing of the foreign substances may be reduced.

FIG. 8 is a cutaway perspective view illustrating a structure of a blocking member according to another embodiment, and FIG. 9 is a perspective view of a blocking rib constituting the blocking member according to another embodiment.

Referring to FIGS. 8 and 9, in a blocking member 30 according to the current embodiment, unlike the foregoing embodiments, blocking ribs 33 that are vertically adjacent to each other may be integrated with each other.

In detail, the blocking member 30 includes a first part 331 and a second part 332. The first part 331 may have the same configuration and structure as those according to the foregoing embodiments. Also, the second part 332 may be the same as those according to the foregoing embodiments in that the outer side surface 332*b* and inner side surface 332*a* of the second part 332 are rounded in the same direction at curvatures different from each other. However, the current embodiment may be different from the foregoing embodiments in that the plurality of second parts 332 that are vertically adjacent to each other are integrated with each other to form one rib that vertically extends.

That is, partition rib through-holes 331*c* through which partition ribs 32 horizontally pass may be defined to be vertically spaced a predetermined distance from each other in the first part 332 of the blocking rib 33. Also, as illustrated in FIG. 8, the blocking member 30 according to the current embodiment may have a structure in which a plurality of blocking ribs 33 are arranged to be horizontally spaced a predetermined distance from each other. Also, the plurality of blocking ribs 33 that are horizontally adjacent to each other and the plurality of partition ribs 32 that are vertically adjacent to each other may be provided as one body through injection molding.

As described above, since the second part 332 of the blocking rib 33 is provided as one body, air discharged from the drying drum may be smoothly guided toward a blower 16.

The invention claimed is:

1. A dryer for clothes, comprising:

a cabinet;

a drying drum accommodated in the cabinet and into which an object to be dried is put;

a suction passage supplying hot air into the drying drum;

a heater provided at a first position of the suction passage to heat the air introduced into the suction passage at a high temperature;

an exhaust passage through which the hot air discharged from the drying drum flows;

a blower mounted at a first position of the exhaust passage to forcibly blow the air within the drying drum;

a lint filter mounted at a second position of the exhaust passage;

a guide duct defining a portion of the exhaust passage to accommodate the lint filter therein; and a blocking member disposed at a position where the air discharged from the drying drum flows, the blocking member configured to filter foreign substances contained in the air discharged from the drying drum before the air discharged from the drying drum is guided to the guide duct, wherein the blocking member comprises:

a plurality of blocking ribs horizontally spaced a predetermined distance from each other; and a plurality of partition ribs horizontally extending and vertically spaced a predetermined distance from each other, the plurality of partition ribs configured to connect the plurality of blocking ribs to each other, wherein one surface of each of the plurality of blocking ribs defines an inclination surface that is inclined at an acute angle, which is less than an angle of 90 degrees, with respect to a vertical surface that extends in a horizontal direction of the drying drum, and wherein each of the plurality of blocking ribs comprises:

a first extension including the inclination surface; and a second extension that extends to be rounded at a predetermined curvature from the first extension.

2. The dryer according to claim 1, wherein the inclination surface is inclined at an acute angle, which is less than the angle of 90 degrees, with respect to a top surface of each of the plurality of partition ribs.

3. The dryer according to claim 1, wherein an outer side surface and an inner side surface of the second extension are rounded in the same direction at curvatures different from each other.

4. The dryer according to claim 3, wherein the inner side surface of the second extension is rounded in the same direction so that the inner side surface is continuously connected to a surface opposite to the inclination surface, and wherein the outer side surface of the second extension is rounded at a predetermined curvature from an end of the inclination surface.

5. The dryer according to claim 1, wherein the second extension is rounded towards the blower.

6. The dryer according to claim 1, wherein the plurality of partition ribs are curved to correspond to a curvature of an input hole of the drying drum, and wherein each of the plurality of partition ribs is inclined downward towards a bottom of the drying drum.

7. The dryer according to claim 1, wherein the second extension of each of the plurality of blocking ribs that are vertically adjacent to each other are spaced a distance corresponding to a thickness of each of the plurality of partition ribs from each other.

8. The dryer according to claim 1, wherein the first extension of each of the plurality of blocking ribs that are vertically adjacent to each other are partitioned by the plurality of partition ribs, and wherein the second extension is provided as one body that vertically extends by a predetermined length.

9. A dryer for clothes, comprising:

a cabinet;

a drying drum accommodated in the cabinet and into which an object to be dried is put;

a suction passage supplying hot air into the drying drum;

a heater provided at a first position of the suction passage to heat the air introduced into the suction passage at a high temperature;

an exhaust passage through which the hot air discharged from the drying drum flows;

a blower mounted at a first position of the exhaust passage to forcibly blow the air within the drying drum;

a lint filter mounted at a second position of the exhaust passage;

a guide duct defining a portion of the exhaust passage to accommodate the lint filter therein; and a blocking member disposed at a position where the air discharged from the drying drum flows, the blocking member configured to filter foreign substances contained in the air discharged from the drying drum before the air discharged from the drying drum is guided to the guide duct, wherein the blocking member comprises:

a plurality of blocking ribs horizontally spaced a predetermined distance from each other; and a plurality of partition ribs horizontally extending and vertically spaced a predetermined distance from each other, the plurality of partition ribs connecting the plurality of blocking ribs to each other, and wherein each of the plurality of blocking ribs extends to be rounded towards the blower.

* * * * *